US006091372A

United States Patent [19]

Dienes

[11] Patent Number: 6,091,372

[45] Date of Patent: Jul. 18, 2000

[54] ANTENNA FOR RADIATING-CABLE TO VEHICLE COMMUNICATION SYSTEMS

[75] Inventor: Geza Dienes, Claremont, Calif.

[73] Assignee: Andrew Corporation, Orland Park, Ill.

[21] Appl. No.: 09/099,335

[22] Filed: Jun. 18, 1998

Related U.S. Application Data

[63] Continuation-in-part of application No. 08/883,607, Jun. 26, 1997.

[51] Int. Cl.[7] ..... H01Q 13/10

[52] U.S. Cl. ..... 343/770; 343/713

[58] Field of Search ..... 343/700 MS, 713, 343/767, 770, 771, 790, 791; 333/84 R, 84 L, 237, 240; H01Q 13/22, 13/20

[56] References Cited

U.S. PATENT DOCUMENTS

| | | | |
|---|---|---|---|
| 2,948,895 | 8/1960 | Ghose et al. | 343/767 |
| 3,031,666 | 4/1962 | Butler | 343/771 |
| 3,648,172 | 3/1972 | Nakahara et al. | 343/771 |
| 3,691,488 | 9/1972 | Holtum, Jr. | 333/84 R |
| 3,729,740 | 4/1973 | Nakahara et al. | 343/771 |
| 3,781,725 | 12/1973 | Yoshida et al. | 333/84 R |
| 3,963,999 | 6/1976 | Nakajima et al. | 333/84 L |
| 4,129,871 | 12/1978 | Johns | 343/771 |
| 4,280,225 | 7/1981 | Willis | 455/55 |

(List continued on next page.)

FOREIGN PATENT DOCUMENTS

| | | | |
|---|---|---|---|
| 0 300 147 | 1/1989 | European Pat. Off. | H01Q 13/20 |
| 82 01456 | 1/1982 | France | H01P 11/00 |
| 26 28 755 | 1/1978 | Germany | H01Q 21/06 |
| 0148302 | 11/1982 | Japan | 343/700 |
| 62-295525 | of 1987 | Japan | H01Q 5/00 |
| 63-287104 | of 1988 | Japan | H01Q 13/22 |
| 2-288604 | of 1990 | Japan | H01Q 13/22 |

OTHER PUBLICATIONS

Levisse, A., Radiating Cables—Channel Tunnel Applications, Electrical Communication, 1st Qtr., 1994, pp. 66–73.

Gale, D. J., and Beal, J. C., Comparative Testing of Leaky Coaxial Cables for Communications and Guided Radar, IEEE Trans. MTT, Sep. 1980; vol. MTT–28, No. 9, pp. 1006–1013.

Sako, T.,Misawa, S., Naruse, T., Yasuhara, H., Oguchi, M., and Kato, T., Leaky Coaxial Cable, Fujikura Technical Review, 1974, pp. 26–39.

Ries, E., and Cuccia, C. L. Status Report: Communications in Mass Transit Guided–Roadway Systems, Microwave Systems News–Urban Communications Report, 1975, pp. 24–42.

Aihara, K., Sakata, Y. and Tago, N., Ultra–High–Bandwidth Heat Resistant Leaky Coaxial Cable, Int'l. Wire & Cable Symp. Proc., 1992,pp. 732–738.

Levisse, A., Leaky or Radiating? Radiation Mechanisms of Radiating Cables and Leaky Feeders—Channel Tunnel Applications, Int'l Wire & Cable Symp. Proc., 1992; pp. 739–747.

(List continued on next page.)

*Primary Examiner*—Don Wong
*Assistant Examiner*—Tho Phan
*Attorney, Agent, or Firm*—Jenkens & Gilchrist

[57] ABSTRACT

A low-loss vehicle communications system including a stationary radiating cable antenna and a slotted array antenna, either of which may be operated as transmitting and/or receiving antennas. The radiating cable antenna includes a plurality of apertures designed to produce a radiated field having a defined phase front in response to excitation of the antenna. The slotted array antenna is mounted to a vehicle movable in an axial direction along a length of the stationary radiating cable antenna. The slotted array antenna includes a corresponding plurality of slots which are oriented so as to couple to the radiated field along a phase front substantially matching the phase front of the radiating cable antenna.

27 Claims, 6 Drawing Sheets

U.S. PATENT DOCUMENTS

| | | | |
|---|---|---|---|
| 4,339,733 | 7/1982 | Smith | 333/237 |
| 4,346,774 | 8/1982 | Hirota et al. | 343/771 |
| 4,366,457 | 12/1982 | Bode et al. | 333/237 |
| 4,599,121 | 7/1986 | Edwards et al. | 156/48 |
| 4,625,187 | 11/1986 | Bocher | 333/237 |
| 4,631,544 | 12/1986 | Ploussios | 343/771 |
| 4,660,007 | 4/1987 | Edwards et al. | 333/237 |
| 4,800,351 | 1/1989 | Rampalli et al. | 333/237 |
| 5,048,641 | 9/1991 | Holcomb et al. | 343/713 |
| 5,291,164 | 3/1994 | Levisse | 333/237 |

OTHER PUBLICATIONS

Coraiola, A., Haag, H. G., Schulze–Buxloh, K., Thönnessen, G., Leaky Coaxial Cable with Length Independent Antenna Receiving Level, Int'l Wire & Cable Symp. Proc.,1992, pp. 748–756.

ANTENNA FOR RADIATING-CABLE TO VEHICLE COMMUNICATION SYSTEMS

CROSS-REFERENCE TO RELATED APPLICATION

This application is a continuation-in-part of pending U.S. application Ser. No. 08/883,607, filed Jun. 26, 1997, which application is hereby incorporated herein by references.

FIELD OF THE INVENTION

The present invention relates generally to communication systems employing a radiating cable antenna for communicating with a mobile vehicular antenna. More particularly, the present invention relates to an improved vehicular antenna adapted to communicate with a stationary radiating cable antenna.

BACKGROUND OF THE INVENTION

A variety of techniques and apparatus have been used to satisfy the requirements of vehicle communication systems. For example, in a vehicle communications system including a stationary antenna communicating with a plurality of mobile antennas, one such technique is to employ a radiating cable antenna as the stationary part of the system and dipole antennas as the mobile part of the system. Generally, radiating cable antennas consist of "leaky" coaxial cables having inner and outer conductors separated by a dielectric material, in which the outer conductor is provided with either a continuous slot or a row of apertures extending lengthwise along the cable. In cables including a row of apertures, many apertures are typically provided per wavelength in order to physically approximate a continuous slot. In either case, the slot or apertures serve to couple electromagnetic signals radiating within the cable to fields radiating outside of the cable, such that the cable may be used as a distributed antenna for transmitting or receiving electromagnetic energy.

The communications coverage area supported by a radiating cable is dependent on the length of the cable, the attenuation of the radiated signal along the length of the cable and the transfer efficiency (or conversely, "coupling loss") between the radiating cable and the receiving antenna. Generally, in a vehicle communication system, the length of the radiating cable is relatively long in order to support a correspondingly large coverage area. Attenuation of the signal will increase in proportion to the length of the cable. Typically, to ensure adequate signal strength along the entire length of the cable, the signal is amplified by a series amplifier positioned along the length of the cable. Because these amplifiers are very expensive, reducing the number of required amplifiers would significantly benefit the design and cost of a radiating-cable to vehicle communication system. This may be accomplished by increasing the transfer efficiency (i.e. reducing the coupling loss) between the radiating cable and the receiving antenna without unduly increasing the cable attenuation.

Another design consideration which would significantly benefit radiatingcable to vehicle communication systems is to improve the consistency of the received signal level. Where dipole antennas are used as the mobile part of the system, it has been determined that the signal received by the dipole can vary approximately 7 to 9 dB with small vehicle movements. Such large variations in the received signal level in response to small vehicle movements necessitates the use of a receiver having a large dynamic range and fast time response and contributes to the degradation of the information being transmitted.

In view of the above, there is a need for a vehicle communications system which increases the transfer efficiency between a stationary radiating cable antenna and a mobile receiving antenna without unduly increasing the cable attenuation, thereby reducing the required number of amplifiers in the system. Moreover, the system should support a received signal level which does not significantly vary in response to small vehicle movements. The present invention is directed to addressing each of the aforementioned needs.

SUMMARY OF THE INVENTION

In accordance with one aspect of the present invention, there is provided a slotted array antenna for communicating with a stationary radiating cable antenna in a vehicle communications system. The radiating cable antenna is adapted to produce a radiated field having a first characteristic phase front in response to excitation of the radiating cable antenna. The slotted array antenna is operable in a transmit mode or receive mode. The slotted array antenna comprises an inner conductor, a dielectric material surrounding the inner conductor and an outer conductor having a first plurality of apertures for passing of electromagnetic radiation therethrough. The apertures are positioned in a predetermined relationship along a length of the slotted array antenna so as to produce a radiated field having a second phase front determined by the positions of said apertures when operated in transmit mode. The slotted array antenna couples to a radiated field along the second phase front when operated in receive mode. In a preferred embodiment of the present invention, the second phase front is substantially parallel to the first phase front.

In accordance with another aspect of the present invention, there is provided a communications system comprising a stationary radiating cable antenna and a mobile slotted array antenna communicating within a prescribed area. The radiating cable antenna includes an outer conductor with a first plurality of apertures for passing of electromagnetic radiation therethrough. The apertures are positioned in a predetermined relationship along a length of the radiating cable antenna so as to produce a radiated field having a first characteristic phase front in response to excitation of the radiating cable antenna. The slotted array antenna is substantially parallel to the radiating cable antenna and includes an outer conductor with a second plurality of apertures for passing of electromagnetic radiation therethrough. The apertures are positioned in a predetermined relationship along a length of the slotted array antenna so as to produce a radiated field having a second characteristic phase front in response to excitation of the slotted antenna. In a preferred embodiment of the present invention, the second phase front is substantially parallel to the first phase front.

BRIEF DESCRIPTION OF THE DRAWINGS

The foregoing and other advantages of the invention will become apparent upon reading the following detailed description and upon reference to the drawings in which.

Figure 1:
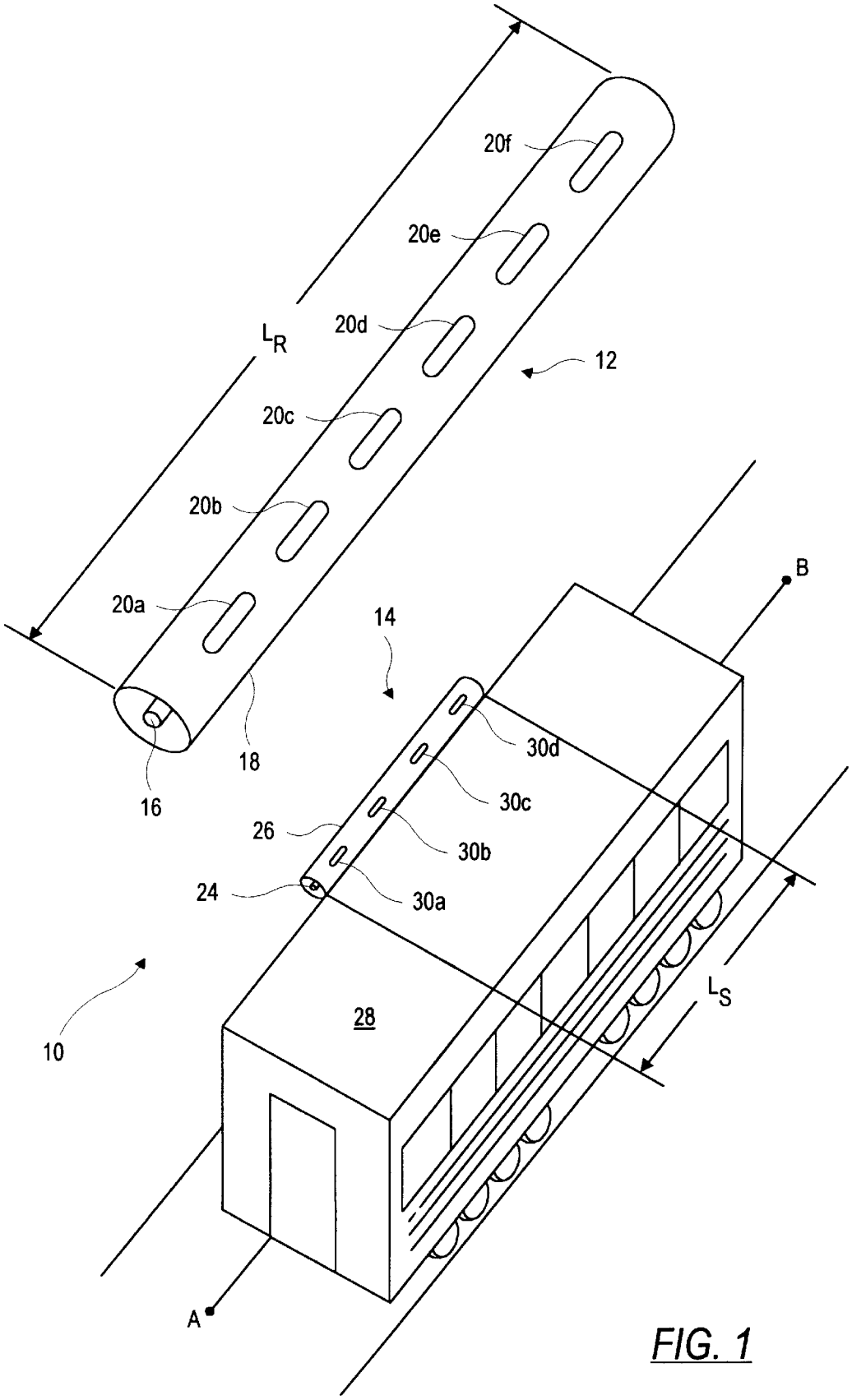
FIG. 1 is a perspective view of a radiating cable-to-vehicle communications system according to one embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings and referring initially to FIG. 1, there is depicted a vehicle communication system, generally designated by reference numeral 10, including a radiating cable antenna 12 and a slotted array antenna 14. The radiating cable antenna 12 comprises the stationary part of the system, typically mounted within a tunnel or open stretch of highway, railroad or subway. The slotted array antenna 14 comprises the mobile part of the system, mounted on any of various vehicles traveling along the highway, railroad or subway.

It will be appreciated that principles of reciprocity permit either of the two antennas 12, 14 to be operated in a transmit mode or receive mode. For example, in one embodiment of the present invention, the radiating cable antenna 12 is characterized as a radiating antenna for transmitting electromagnetic energy, while the slotted array antenna 14 is characterized as a receiving antenna for receiving electromagnetic energy. In an alternative embodiment of the present invention, the slotted array antenna 14 is characterized as a transmitting antenna and the radiating cable antenna 12 is characterized as a receiving antenna. In general, however, it is expected that neither antenna will be utilized exclusively as a transmitting or receiving antenna, but rather each antenna will be operated in both transmit mode and receive mode.

Moreover, because antennas are generally more easily described and understood in relation to their radiation characteristics, the discussion to follow may occasionally describe the respective antennas in terms of their radiated fields, radiation pattern, etc. whether they are being used as a transmitting or receiving antenna. Nevertheless, it will be appreciated that such descriptions generally do not mean that the receiving antenna is producing a radiated field, but rather is coupling to fields produced by the transmitting antenna according to a pattern determined from principles of reciprocity.

The radiating cable antenna 12 is of the type known in the art, comprised of a length $L_R$ of coaxial cable having an inner conductor 16 and an outer conductor 18 separated by a dielectric material (not shown). The outer conductor is provided with a row of apertures 20*a*, 20*b*, 20*c* . . . 20*n*$_1$ (or alternatively, a continuous slot) extending lengthwise along the cable. To operate the antenna 12 as a transmitting antenna, the antenna 12 is excited by applying a radio frequency (RF) signal to the inner conductor 16, the frequency of which depends on the communications application for which the antenna 12 is intended. For example, in an embodiment of the present invention utilizing the antenna 12 in a train communication system, the antenna 12 is excited with an RF signal lying in the relatively narrow frequency rage of 2400–2480 MHz. After the excitation of the antenna 12, an electromagnetic field is generated which propagates in a TEM mode along the length of the cable. The guide wavelength and velocity of propagation of the electromagnetic field is dependent on the excitation of frequency and the dimensions and materials of the cable.

As the field propagates along the cable, it successively encounters the various apertures 20*a*, 20*b*, 20*c* . . . 20*n*$_1$ positioned along the length of the cable. Typically, each aperture is separated from the next successive aperture by a distance proportional to the guide wavelength such as, for example, one-half or one-quarter of a wavelength between apertures. Alternatively, the apertures may be unequally spaced along the length of the cable. In either case, attenuation of the signal along the cable will increase in proportion to the length of the cable and in proportion to the amount of signal radiated from the apertures 20*a* . . . 20*n*$_1$. Thus, at long lengths of cable, amplifiers (not shown) may be required to boost the signal at various points along the length of the cable 12 so that the radiated field is maintained at an acceptable level throughout the entire length of the cable.

When the RF energy propagating along the cable encounters an aperture, a portion of the energy "leaks" out into the atmosphere thus defining an individual "wave" of RF energy. The remaining portion of the RF energy continues to propagate within the cable and encounters the remaining apertures in succession, thus producing a plurality of individual waves of RF energy. The individual waves of energy each contribute to a radiated field external to the cable which can be detected by a receiving antenna. Typically, the magnitude of the waves of energy emanating from the apertures do not significantly vary from one aperture to the next, but the phase of the waves vary in relation to the position of the respective apertures along the length of the cable.

Figure 3:
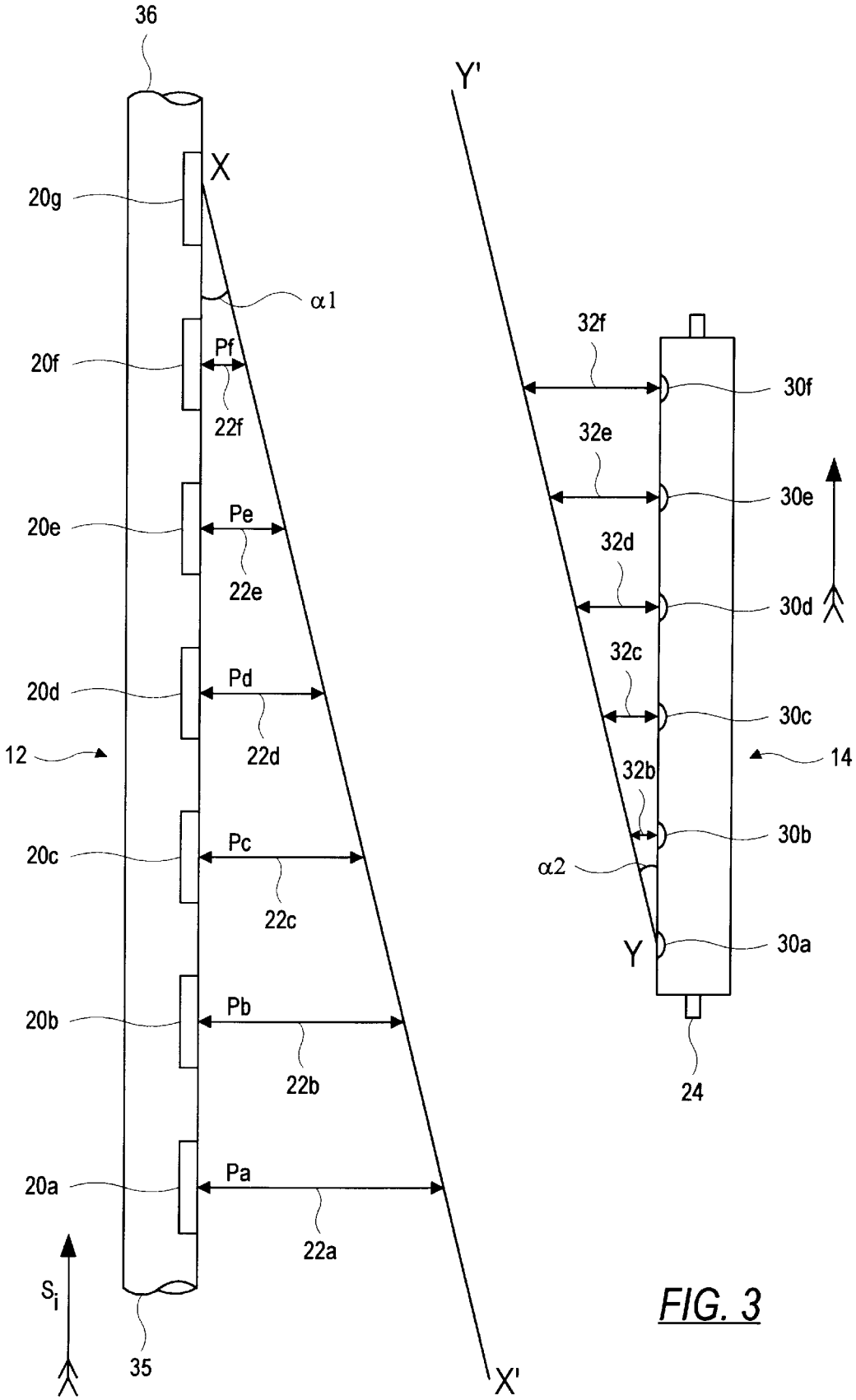
FIG. 3 is a top view of a radiating cable-to-vehicle communications system illustrating matching phase fronts in transmitting and receiving antennas according to principles of the present invention.

For example, with reference to FIG. 3, RF energy propagating from left-to-right within the radiating cable antenna 12 will first encounter aperture 20*a* at time $t_0$, causing a portion of the RF energy (designated by arrow 22*a*) to leak out of aperture 20*a* into the atmosphere. Then, at time $t_1$, the RF energy propagating through the radiating cable antenna 12 will encounter aperture 20*b*, causing a portion of the RF energy (designated by arrow 22*b*) to leak out of aperture 20*b* into the atmosphere. Thereafter, the RF energy successively encounters remaining apertures 20*c* . . . 20*n*$_1$ at times $t_2$ . . . $t_n$, similarly releasing a portion of the RF energy (designated by arrows 22*c* . . . 20*n*$_1$) to leak out into the atmosphere. The respective time intervals ($t_0$, $t_1$), ($t_1$, $t_2$), etc. between encountering each successive aperture is determined by the distance between apertures and the velocity of propagation of the RF signal in the cable.

The time intervals between apertures cause the waves of energy emanating from each successive aperture to differ in phase from one another. These phase differences are depicted graphically in FIG. 3 by the length of successive arrows 22*a* . . . 22$n_1$, with the length of the arrows corresponding to the relative phases of the individual waves. For example, the longest arrow 22*a* represents the wave of energy emanating from aperture 20*a*. The next longest arrow 22*b* is shorter in length than arrow 22*a* because it represents a phase lag from aperture 20*a* to 20*b*, and so on. The superposition of the phases of each individual wave thereby defines a phase front of the radiated field emerging from the radiating cable antenna 12.

In one embodiment of the present invention, the radiated field produced by the radiating cable antenna 12 is adapted to be received by a slotted array antenna 14 mounted on a vehicle such as, for example, a railroad car or automobile, such that the axis of the antenna 14 is parallel to the stationary radiating cable antenna and the ground. One such configuration is depicted in FIG. 1, with the slotted array antenna 14 mounted on a vehicle 28 comprising a railroad car. Moreover, in a preferred embodiment, the slotted array antenna 14 is mounted to the vehicle 28 in an orientation substantially parallel to the axis of the radiating cable antenna 12. In a preferred embodiment, the vehicle 28 is adapted to move in an axial direction substantially parallel to the radiating cable antenna 12. For example, with respect to FIG. 1, the vehicle 28 may move in either direction along a line drawn from A to B, with the line AB being substantially parallel to the radiating cable antenna 12.

The slotted array antenna 14 is comprised of a length $L_S$ of cable having a cylindrical inner conductor 24 and outer conductor 26 separated by a dielectric material (not shown). The length $L_S$ of the slotted array antenna 14 is sized to facilitate mounting on the vehicle 28. The outer conductor 26 includes an array of longitudinal slots 30*a*, 30*b* . . . 30$n_2$ extending lengthwise along the antenna. Similar to the radiating cable antenna 12, the slotted array antenna 14 may be operated as a transmitting antenna or receiving antenna. The physical dimensions, number of slots, distance between slots, etc. of the slotted array antenna are somewhat arbitrary. For example, it is envisioned that the outer conductor 26 may be as small as one-half inch in diameter and as large as six inches in diameter, and the number of slots may be varied from about three to fifteen in number.

In one embodiment, a reflector (not shown) is positioned behind the slotted array antenna 14 (e.g., on the mounting surface of vehicle 28). The reflector serves to decouple the antenna 14 from the vehicle 28 and other objects behind it so as to reduce or eliminate any detrimental effects from the vehicle and/or objects. When the antenna 14 is used as a transmitting antenna, the reflector creates a wide beam in the plane perpendicular to the array, covering an angular range from the ground to zenith on the side of the vehicle 28 facing the receiving antenna 12.

To operate as a transmitting antenna, the slotted array antenna 14 is excited by applying an RF signal of a selected frequency (e.g. 2400 to 2480 MHz) to the inner conductor 24, thus generating an electromagnetic field propagating along the length $L_S$ of the antenna 14 between the inner and outer conductors 24, 26. The guide wavelength and velocity of propagation of the electromagnetic field is dependent on the excitation frequency and the dimensions and materials of the antenna 14. As the field propagates along the cable, it successively encounters the various slots 30*a*, 30*b*, 30*c* . . . 30$n_2$ positioned on the antenna 14.

Figure 2A:
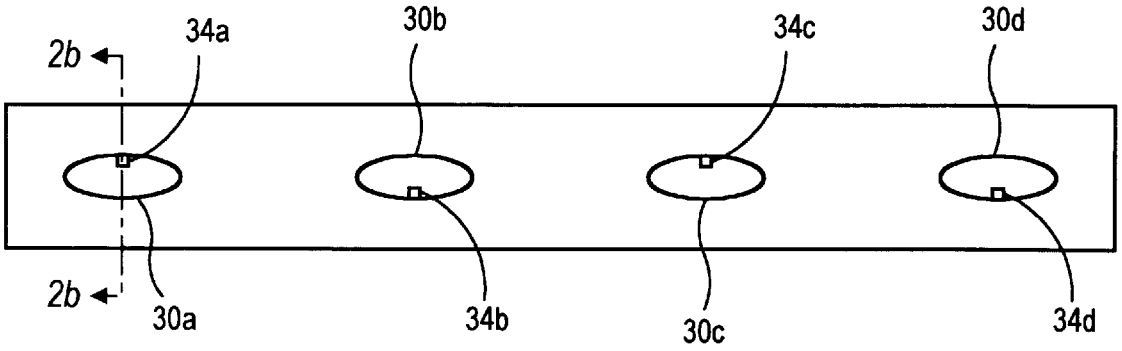
FIG. 2*a* is a side elevation view of a slotted array antenna which may be utilized in a radiating cable-to-vehicle communications system according to one embodiment of the present invention.
Figure 2B:
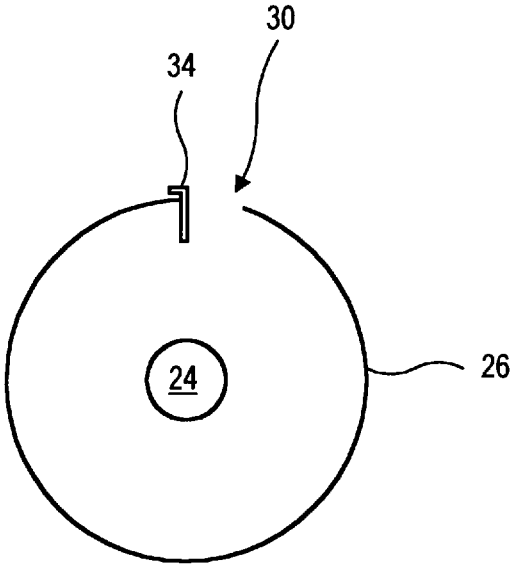
FIG. 2*b* is a cross-sectional view of the slotted array antenna depicted in FIG. 2*a;*

Now referring to FIG. 2*a*, the various slots 30*a* . . . 30$n_2$ of the slotted array antenna 14 couple to the RF energy propagating in the cable by means of respective metallic protrusions 34*a* . . . 34$n_2$, causing the slots to radiate individual pockets or waves of RF energy into the atmosphere, similar to the radiating cable waveguide 12. As can be seen most clearly in FIG. 2*b*, the protrusions 34 are positioned within the slot 30 such that they are connected to the outer conductor 26 and extend part-way toward the inner conductor 24 of the antenna 14. In one embodiment, the metallic protrusions 34*a* . . . 34$n_2$, are centered on alternating sides of the respective slots 30*a* . . . 30$n_2$ along the length of the slotted array antenna 14. For example, as shown in FIG. 2*a*, protrusions 34*a*, 34*b*, 34*c* and 34*d* are centered, respectively, on the upper, lower, upper and lower side of consecutive slots 30*a*, 30*b*, 30*c* and 30*d*. However, it will be appreciated that the protrusions 34 may be positioned in any of several alternative orientations relative to the slots 30.

Each of the individual waves of energy (depicted by arrows 32*a* . . . 32$n_2$) emanating from the respective slots 30 is delayed in phase from the waves emanating from previous slots. The combination or superposition of waves from each slot defines a phase front associated with the slotted array antenna 14. The characteristics of the phase front is determined by the frequency, distance between slots and the velocity of propagation of the RF signal in the cable.

When operated as a receiving antenna, the slotted array antenna 14 is designed to couple to the radiated field generated from the radiating cable antenna 12. According to principles of the present invention, this coupling may be achieved with less coupling loss (e.g. higher transfer efficiency) than other communication systems known in the art, by coupling to the radiated field along a matching phase front. More specifically, the distance between slots 30 and the velocity and direction of propagation of the signal in the slotted array antenna 14 are selected so as to generate a radiated field with an emerging phase front that progressively matches the phase front produced by the radiating cable antenna 12.

For example, in one embodiment of a train communications system utilizing principles of the present invention, the radiating cable 12 is used as a transmitting antenna and the slotted array antenna 14 is used as a receiving antenna. An excitation signal of 2400–2480 MHz is applied to the radiating cable 12, causing a radiated field to be generated in the direction of the slotted array antenna 14. As described above, the phase front of the generated field is dependent on the velocity of propagation in the cable 12 and the distance between successive apertures 20*a* . . . 20$n_1$. For purposes of the present example, it will be assumed that the apertures 20*a* . . . 20$n_1$ are each spaced one-half of a guide wavelength from the next successive aperture.

To couple to the radiated phase field along a matching phase front, the orientation of the slotted array antenna 14, slot characteristics and direction and velocity of propagation within the slotted array antenna 14 are selected to "match" or at least substantially match that of the radiating cable 12. The greater degree of match or equalization between antennas corresponds a greater level of transfer efficiency (and reduced coupling loss) between antennas. Again, it will be appreciated that the degree of coupling loss between the two antennas is substantially independent of which antenna is being used as a transmitting antenna and which antenna is being used as a receiving antenna.

With respect to orientation of the antennas 12, 14, the greatest benefit may be achieved where the axis of the stationary and mobile antennas are oriented parallel to each other. This optimal antenna orientation may be easily controlled, for example, in a railroad or subway communications system in which the stationary radiating cable antenna is mounted parallel to the ground, inside or outside of a tunnel, and the slotted array antenna 14 is mounted parallel to the ground, on the side of one or more railroad or subway cars. However, it will be appreciated that the present invention is not limited to railroad or subway applications.

Another design consideration which affects the degree of "match" between phase fronts is the comparative distance between apertures 20 and slots 30, respectively, of the radiating cable antenna 12 and slotted array antenna 14. With respect to slot distance, however, the comparative distances need not "match" each other but generally are at least proportional to each other. For instance, in the example heretofore described, with the apertures 20*a* . . . 20$n_1$ of the radiating cable 12 spaced one-half of a guide wavelength apart, the slots 30*a*, 30*b*, 30*c* . . . 30$n_2$ of the slotted array antenna 14 may be spaced one-half, one-quarter or other suitable proportion of a guide wavelength from the next successive slot.

Figure 4:
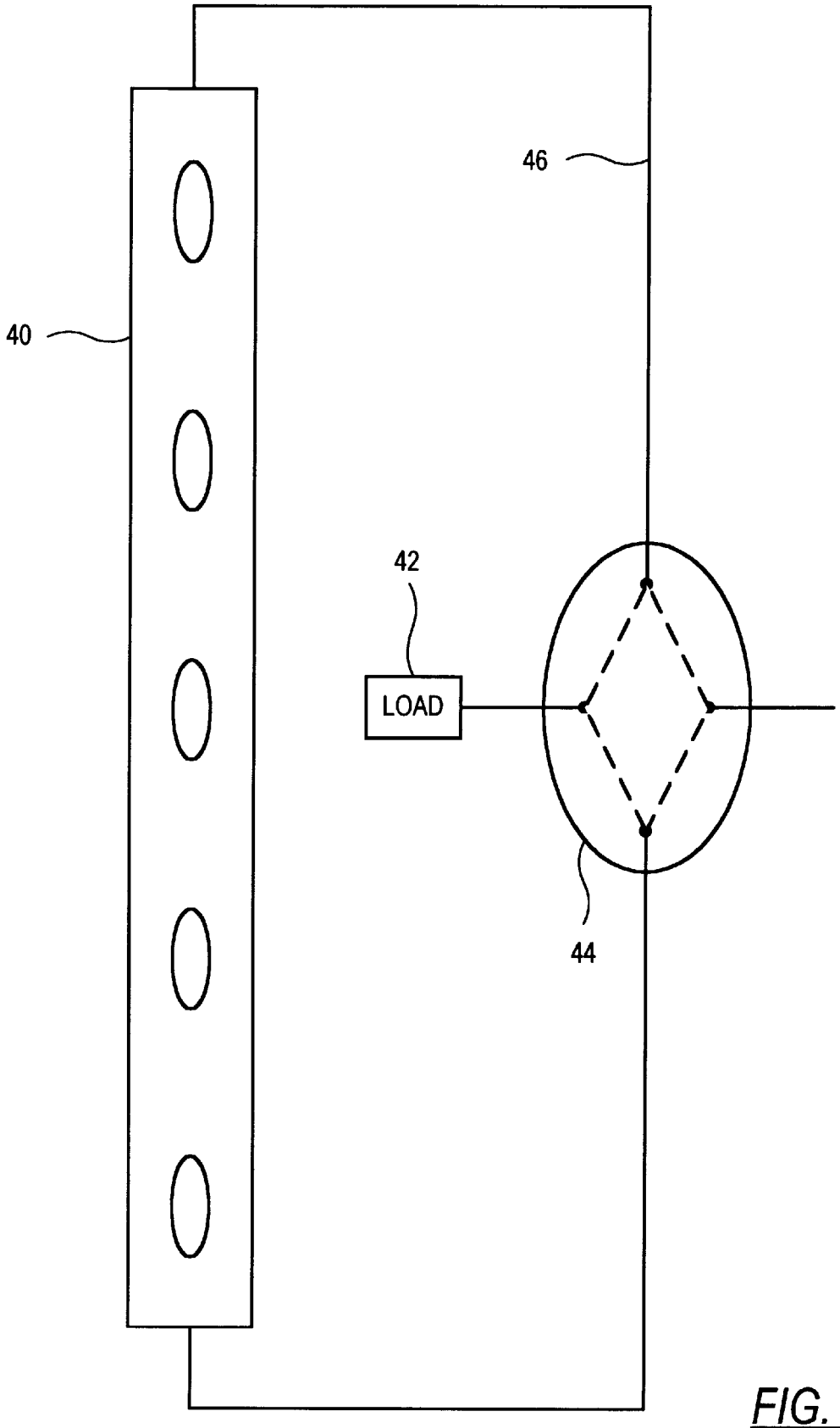
FIG. 4 depicts a circuit configuration which may be utilized in a radiating cable-to-vehicle communications system according to one embodiment of the present invention.

FIG. 4 illustrates a simple circuit configuration which may be utilized with a slotted array antenna according to one embodiment of the present invention. As shown in FIG. 4, a slotted array antenna 40 is connected via cable 46 to a load 42. The load 42 terminates the antenna 40 in a matched impedance. In one embodiment, the load 42 comprise a device such as a transmitter or receiver which exhibits an impedance matching that of the antenna 40. The susceptance of the slots is adjusted so that most of the signal entering the antenna will be radiated and only a small portion of it (on the order of −6 to −20 dB) will be absorbed by the load. A transfer switch 44 enables an operator to selectively adjust the direction of propagation of the signal within the antenna 40, so that it matches the direction of propagation in the corresponding radiating cable antenna (not shown in FIG. 4). More specifically, through appropriate adjustment of the transfer switch 44, the direction of propagation of the signal within the antenna 40 may be selected or reversed from a previous direction.

Figure 5A:
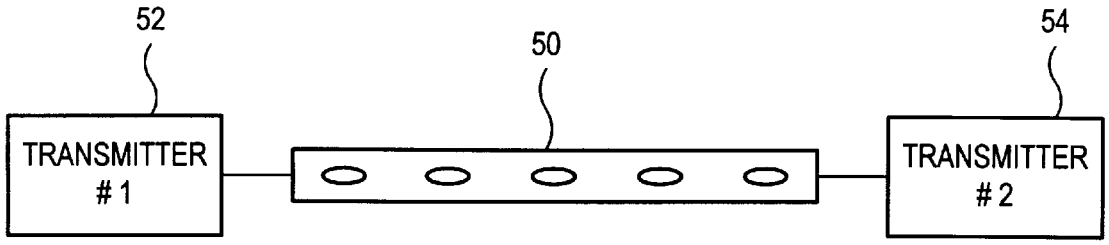
FIGS. 5*a* and 5*b* are block diagrams of a slotted array antenna operated in a diversity system according to different embodiments of the present invention.
Figure 5B:
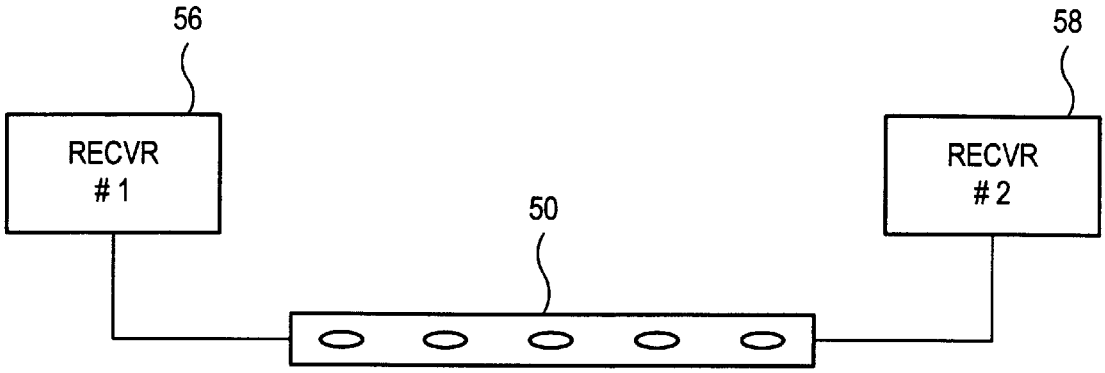

According to one embodiment of the present invention, the slotted array antenna may be operated as a diversity antenna. This may be accomplished by attaching separate transmitters 52, 54 (FIG. 5*a*) or separate receivers 56, 58 (FIG. 5*b*) to each end of a slotted array antenna 50. For example, FIG. 5*a* depicts a diversity system in which the slotted array antenna 50 is being used as a transmitting antenna, while FIG. 5*b* depicts a diversity system in which the slotted array antenna 50 is being used as a receiving antenna. In FIG. 5*a*, transmitter 52 excites a signal propagating through antenna 50 toward transmitter 54, while transmitter 54 simultaneously excites a signal propagating in an opposite direction through antenna 50 toward transmitter 52. The two oppositely-directed signals each generate a radiated field with a different phase front externally to the antenna 50, either of which may be received by a receiving antenna. In FIG. 5*b*, the diversity system is designed to receive signals from a radiated field by coupling to the radiated field along two different phase fronts, in the manner heretofore described.

Typically, in a diversity system, the "isolation" between receivers or transmitters must be on the order of 20 to 30 dB. In the embodiments depicted in FIGS. 5*a* and 5*b*, the required isolation is accomplished in part through attenuation in the antenna 50 and in part through the phase front mismatch in the two different propagating directions. For example, isolation sufficient for a diversity system may be achieved by adjusting the susceptance of the slots so that the signal level reaching the far end of the antenna (opposite the input end) is 13 to 15 dB less than the signal level at the input end of the antenna. The remaining contribution to the isolation is furnished by the phase mismatch between the two propagating directions in the antenna.

Figure 6:
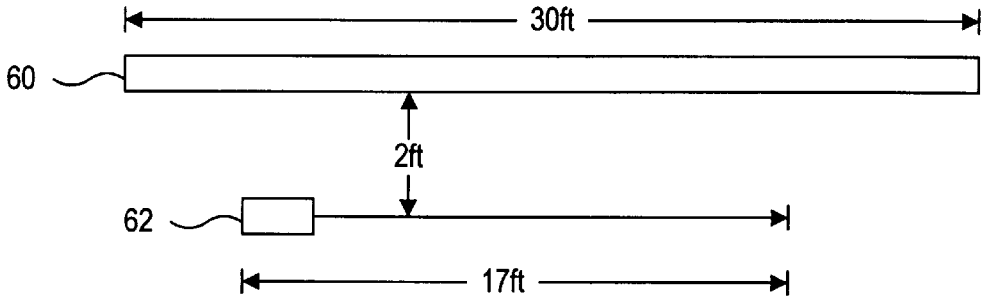
FIG. 6 is a block diagram of a test set-up used to obtain experimental data regarding a radiating cable-to-vehicle communication system according to one embodiment of the present invention.

Experimental data has demonstrated that the use of the slotted array antenna 14 rather than a conventional dipole antenna in a vehicle communication system significantly improves both the transfer efficiency and the consistency of the received signal level. FIG. 6 shows a test setup that was used to obtain such experimental data in an acoustically insulated test chamber. A 30 foot length of radiating cable antenna 60 simulating the stationary portion of a vehicle communication system was excited with an RF signal at 2400–2480 MHz so as to produce a radiated field in the direction of a receiving antenna 62. In separate trials, a vertical dipole antenna and a slotted array antenna were used as test receiving antennas, positioned about 24 inches away from the axis of the radiating cable antenna 60. The respective receiving antennas 62 were advanced in two-inch increments over a 17-foot distance parallel to the axis of the radiating cable antenna 60.

The slotted array antenna used in the test set-up consisted of 10 axial slots machined in a 1⅝ inch diameter rigid coaxial outer conductor, with a reflector positioned behind the antenna as heretofore described. The array element (slot) spacing, slot characteristics and the velocity of propagation were analyzed and chosen so that the phase slope of the field generated by the slotted array antenna would match the phase slope of the field generated by the radiating antenna 60.

Figure 7:
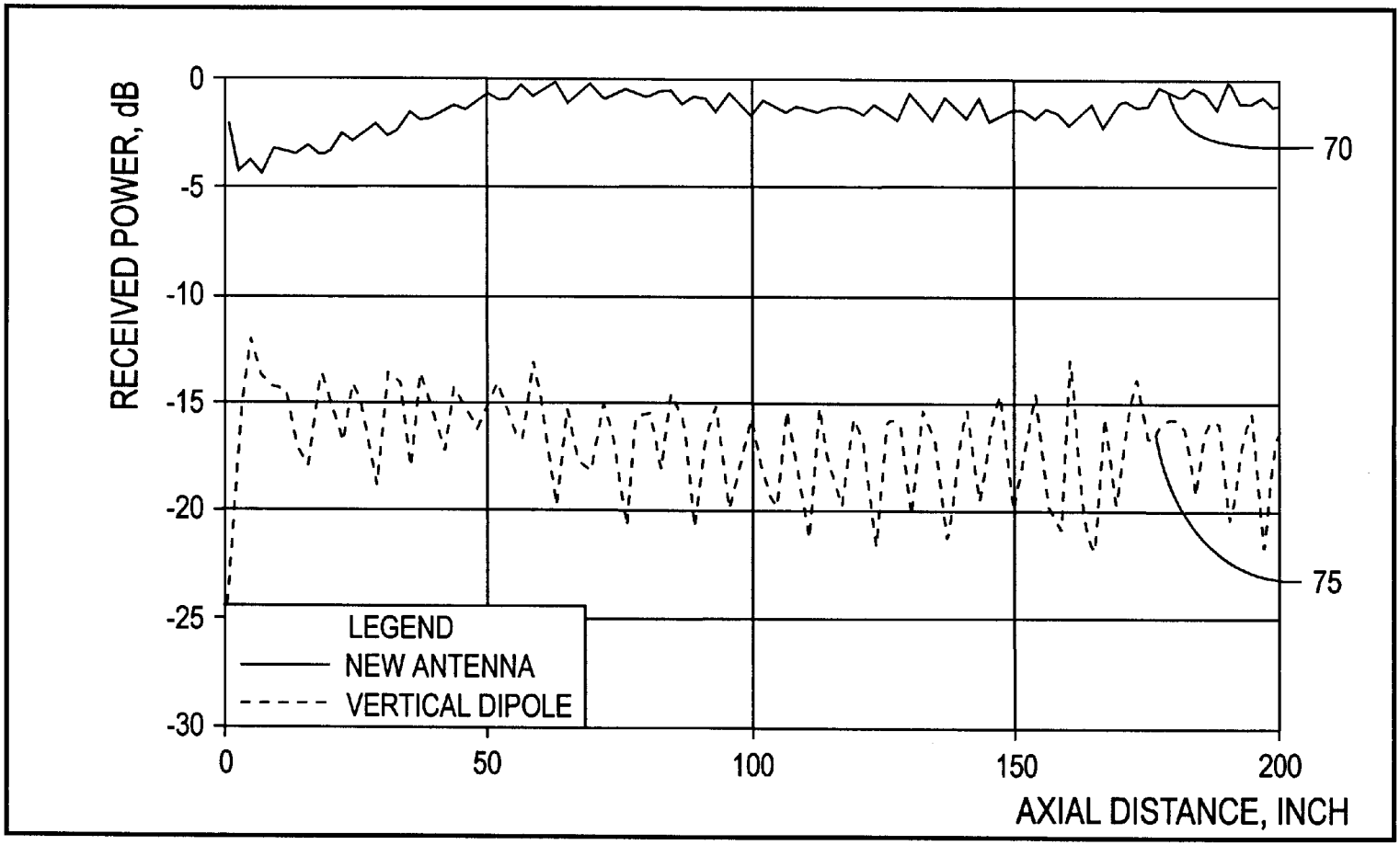
FIG. 7 is a plot of experimental data obtained using the test set-up of FIG. 6.

FIG. 7 illustrates the received power versus axial location for the vertical dipole antenna (designated by reference numeral 75) and the slotted array antenna (designated by reference numeral 70). As can be observed in FIG. 7, the average signal level 70 received by the slotted array antenna is about 12–15 dB higher than the average signal level 75 received by the vertical dipole antenna. The difference between the minimum signal level received by the slotted array antenna versus that received by the dipole is about 17–19 dB. This would suggest that, in a vehicle communications system utilizing a radiating cable antenna and a slotted array antenna, the cable length between amplifiers could be increased by about 10–12 dB worth of attenuation or about 400 feet (about 30 to 50 percent). This would reduce the number of amplifiers needed in the communication system by about 30 to 50 percent.

FIG. 7 also demonstrates a significant improvement in the "smoothness" of the received signal level. The signal 75 received by the dipole varies 7 to 9 dB from point to consecutive point, which are only two inches apart. Conversely, the signal received by the slotted array antenna 14 varies only 1 to 2 dB from point to consecutive point. This suggests that in a vehicle communications system utilizing a radiating cable antenna and a slotted array antenna, the received signal will remain relatively stable in response to small vehicle movements. Accordingly, there will be less distortion of the information being transmitted, and there will be less demand for receivers having a large dynamic range and fast time response.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A slotted array antenna for communicating with a stationary radiating cable antenna in a vehicle communications system, said radiating cable antenna being adapted to produce a radiated field having a first characteristic phase front and a first phase velocity in response to excitation of said radiating cable antenna, said slotted array antenna being operable in a transmit mode or receive mode, said slotted array antenna comprising:

an inner conductor; a dielectric material surrounding said inner conductor; and an outer conductor having a first plurality of apertures for passing of electromagnetic radiation therethrough, said apertures having been positioned in predetermined relationship along a length of said slotted array antenna, said slotted array antenna being adapted to produce a radiated field having a second phase front and a second phase velocity determined by the positions of said apertures when operated in said transmit mode, said slotted array antenna being adapted to couple to a radiated field along said second phase front when operated in said receive mode, wherein the second phase velocity substantially matches the first phase velocity throughout a range of frequencies.

2. The slotted array antenna according to claim 1 wherein the first characteristic phase front is substantially parallel to the second characteristic phase front.

3. The slotted array antenna according to claim 1 having an axis substantially parallel to the axis of said radiating cable antenna.

4. The slotted array antenna according to claim 3 being attached to a mobile vehicle movable in a direction substantially parallel to the axis of said radiating cable antenna.

5. The slotted array antenna according to claim 4 wherein a reflector is positioned between the slotted array antenna and the vehicle.

6. The slotted array antenna according to claim 1 wherein each of said apertures include respective metallic protrusions for coupling to radiated fields.

7. The slotted array antenna according to claim 6 wherein said metallic protrusions are positioned on alternate sides of consecutive ones of said apertures.

8. The slotted array antenna according to claim 1 wherein consecutive ones of said apertures are separated by a distance of one-quarter of a wavelength.

9. The slotted array antenna according to claim 1 wherein consecutive ones of said apertures are separated by a distance of one-half of a wavelength.

10. A communications system comprising a stationary radiating cable antenna and a mobile slotted array antenna communicating within a prescribed area, said radiating cable antenna including an outer conductor with a first plurality of apertures for passing of electromagnetic radiation therethrough, said apertures having been positioned in predetermined relationship along a length of said radiating cable antenna so as to produce a radiated field having a first characteristic phase front and a first phase velocity in response to excitation of said radiating cable antenna;

said slotted array antenna being substantially parallel to said radiating cable antenna and including an outer conductor with a second plurality of apertures for passing of electromagnetic radiation therethrough, said apertures having been positioned in predetermined relationship along a length of said slotted array antenna so as to produce a radiated field having a second characteristic phase front and a second phase velocity in response to excitation of said slotted antenna, wherein the second phase velocity substantially matches the first phase velocity throughout a range of frequencies.

11. The communications system according to claim 10 wherein the first characteristic phase front is substantially parallel to the second characteristic phase front.

12. The communications system according to claim 10 wherein the slotted array antenna has an axis substantially parallel to the axis of said radiating cable antenna.

13. The communications system according to claim 12 wherein the slotted array antenna is attached to a mobile vehicle movable in a direction substantially parallel to the axis of said radiating cable antenna.

14. The communications system according to claim 13 wherein a reflector is positioned between the slotted array antenna and the vehicle.

15. The communications system according to claim 10 wherein consecutive ones of the apertures of said radiating cable antenna are separated by a distance proportional to the distance between consecutive ones of the apertures of said slotted array antenna.

16. A method of communicating between a stationary radiating cable antenna and a vehicle in a prescribed area, said vehicle being movable in an axial direction along a length of said radiating cable antenna, said radiating cable antenna including an outer conductor with a first plurality of apertures for passing of electromagnetic radiation therethrough, said apertures having been positioned in predetermined relationship along a length of said radiating cable antenna so as to produce a radiated field having a first characteristic phase front and a first phase velocity in response to excitation of said radiating cable antenna, said method comprising the steps of:

exciting said radiating cable antenna with an electromagnetic signal to produce a radiated field having said first characteristic phase front and said first phase velocity;

mounting a slotted array antenna to said vehicle, said slotted array antenna being substantially parallel to said radiating cable antenna and including an outer conductor with a second plurality of apertures for passing of electromagnetic radiation therethrough, said apertures having been positioned in predetermined relationship along a length of said slotted array antenna; and receiving a portion of said radiated field at said slotted array antenna by coupling to said radiated field along a second characteristic phase front, said second characteristic phase front and a second phase velocity of the slotted array antenna being determined by the positions of said second plurality of apertures, wherein said second phase velocity substantially matches said first phase velocity throughout a range of frequencies.

17. The method of claim 16 wherein said electromagnetic signal comprises a radio frequency signal.

18. The method of claim 16 wherein said electromagnetic signal comprises a radio frequency signal having a frequency between 2400 MHz and 2480 MHz.

19. The method of claim 16 wherein the portion of said radiated field received by said slotted array antenna defines a received signal, said received signal remaining substantially constant in response to movement of said vehicle in an axial direction along a length of said radiating cable antenna.

20. The method of claim 16 wherein the portion of said radiated field received by said slotted array antenna defines a received signal, said received signal having a magnitude substantially independent of changes in frequency of said electromagnetic signal.

21. The method of claim 16 wherein the portion of said radiated field received by said slotted array antenna defines a received signal, said received signal having a magnitude substantially independent of the direction of propagation of said electromagnetic signal in said radiating cable antenna.

22. A method of communicating between a stationary radiating cable antenna and a vehicle in a prescribed area, said vehicle being movable in an axial direction along a length of said radiating cable antenna, said radiating cable antenna including an outer conductor with a first plurality of apertures for passing of electromagnetic radiation therethrough, said apertures having been positioned in predetermined relationship along a length of said radiating cable antenna so as to receive radiated fields having a first phase velocity within said prescribed area along a first characteristic phase front, said method comprising the steps of:

mounting a slotted array antenna to said vehicle, said slotted array antenna being substantially parallel to said radiating cable antenna and including an outer conductor with a second plurality of apertures for passing of electromagnetic radiation therethrough, said apertures having been positioned in predetermined relationship along a length of said slotted array antenna so as to produce a radiated field having a second characteristic phase front and a second phase velocity in response to excitation of said slotted array antenna;

exciting said slotted array antenna with an electromagnetic signal to produce a radiated field having said second characteristic phase front and said second phase velocity; and receiving a portion of said radiated field at said radiating cable antenna by coupling to said radiated field along said first characteristic phase front, wherein said first phase velocity substantially matches said second phase velocity throughout a range of frequencies.

23. The method of claim 22 wherein said electromagnetic signal comprises a radio frequency signal.

24. The method of claim 22 wherein said electromagnetic signal comprises a radio frequency signal having a frequency between 2400 MHz and 2480 MHz.

25. The method of claim 22 wherein the portion of said radiated field received by said radiating cable antenna defines a received signal, said received signal remaining substantially constant in response to movement of said vehicle in an axial direction along a length of said radiating cable antenna.

26. The method of claim 22 wherein the portion of said radiated field received by said radiating cable antenna defines a received signal, said received signal having a magnitude substantially independent of changes in frequency of said electromagnetic signal.

27. The method of claim 22 wherein the portion of said radiated field received by said radiating cable antenna defines a received signal, said received signal having a magnitude substantially independent of the direction of propagation of said electromagnetic signal in said slotted array antenna.

* * * * *